US005881843A

United States Patent [19]

O'Donnell et al.

[11] Patent Number: 5,881,843

[45] Date of Patent: Mar. 16, 1999

[54] SYNTHETIC NON-METALLIC ROPE FOR AN ELEVATOR

[75] Inventors: Hugh J. O'Donnell, Longmeadow, Mass.; Eric G. Olsen, Southbury, Conn.

[73] Assignee: Otis Elevator Company, Farmington, Conn.

[21] Appl. No.: 729,975

[22] Filed: Oct. 15, 1996

[51] Int. Cl.[6] ..... B66B 11/08

[52] U.S. Cl. ..... 187/254; 57/231

[58] Field of Search ..... 187/254, 251, 187/414, 411; 57/231, 232

[56] References Cited

U.S. PATENT DOCUMENTS

| | | | |
|---|---|---|---|
| 3,279,762 | 10/1966 | Burns | 254/266 |
| 3,332,665 | 7/1967 | Bruns | 187/254 |
| 4,022,010 | 5/1977 | Gladenbeck et al. | 57/149 |
| 4,022,101 | 5/1977 | Gladenbeck et al. | 57/231 |
| 4,059,951 | 11/1977 | Roe | 57/149 |
| 4,550,559 | 11/1985 | Thomson | 57/223 |
| 4,624,097 | 11/1986 | Wilcox | 57/232 |
| 4,887,422 | 12/1989 | Klees et al. | 57/220 |
| 5,526,552 | 6/1996 | De Angelis | 24/136 L |
| 5,566,786 | 10/1996 | De Angelis et al. | 187/266 |

FOREIGN PATENT DOCUMENTS

| | | |
|---|---|---|
| 2142072 | 9/1995 | Canada . |
| 495911 | 10/1970 | Switzerland . |

OTHER PUBLICATIONS

PCT Search Report for Serial No. PCT/US97/15406 dated Oct. 5, 1998.

*Primary Examiner*—Kenneth Noland

[57] ABSTRACT

A hoist rope for an elevator is formed from synthetic, non-metallic materials. The hoist rope includes a plurality of load-carrying strands with each strand encased within a coating layer. The coating layers provide protection against wear and provide sufficient lubricity to permit relative movement of the strands to equalize loading on the strands. The plurality of strands are surrounded by a jacket. The jacket provides sufficient traction with a traction sheave, transfers traction loads to the strands while permitting movement of the strands, and provides a flame retardant characteristic to the hoist rope. In one embodiment of an passenger conveyor system, the hoist rope is engaged with a traction sheave having a sheave liner the material for the jacket and sheave liner are selected to optimize the coefficient of friction between the hoist rope and traction sheave.

34 Claims, 2 Drawing Sheets

FIG. 2
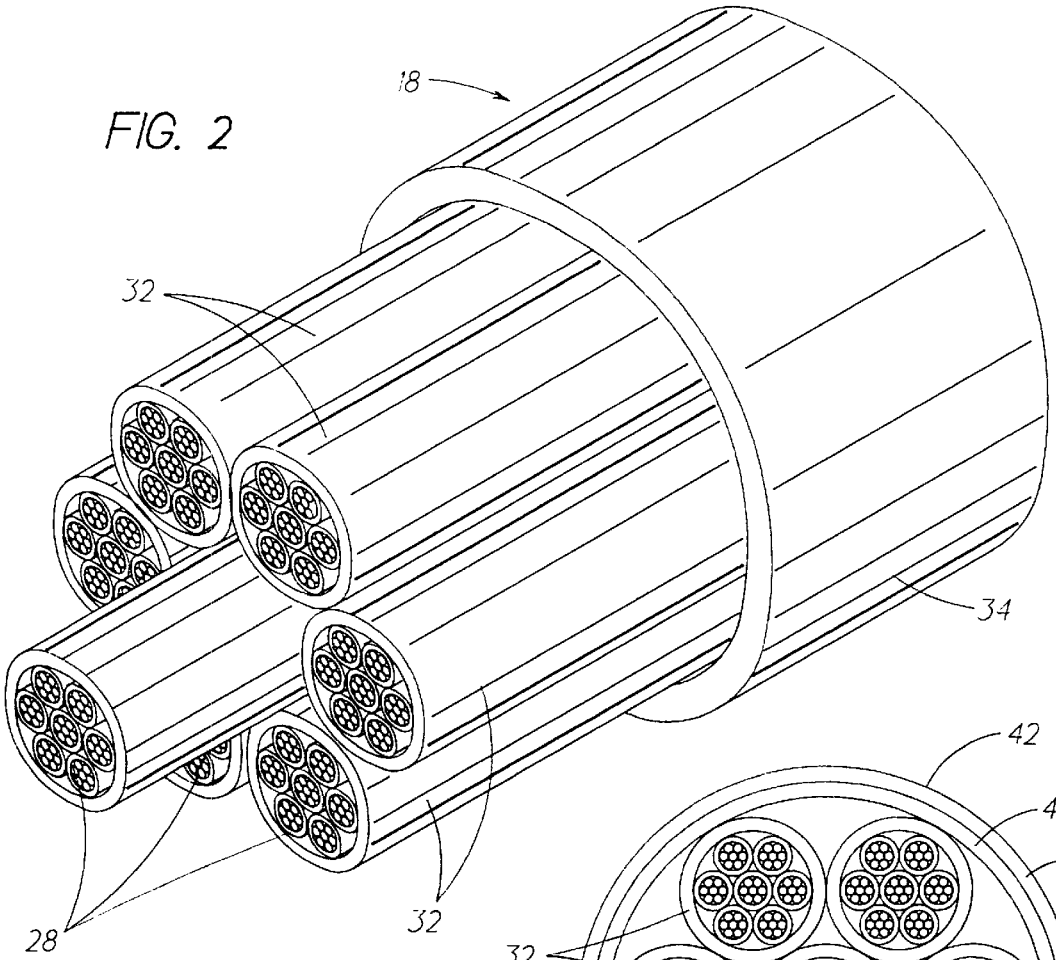
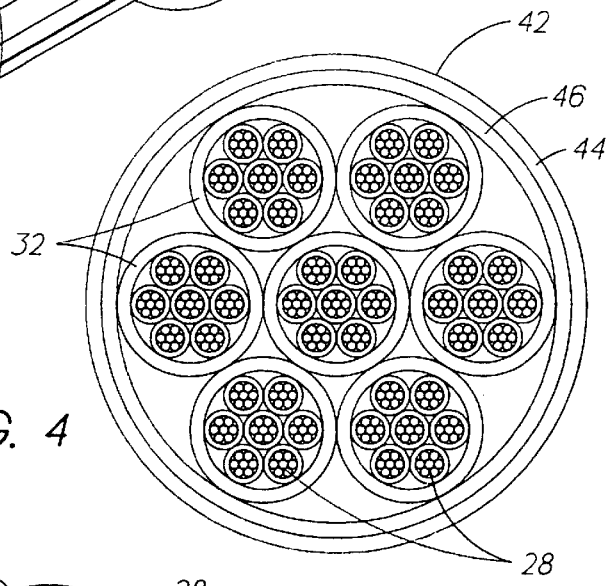
FIG. 4
FIG. 3
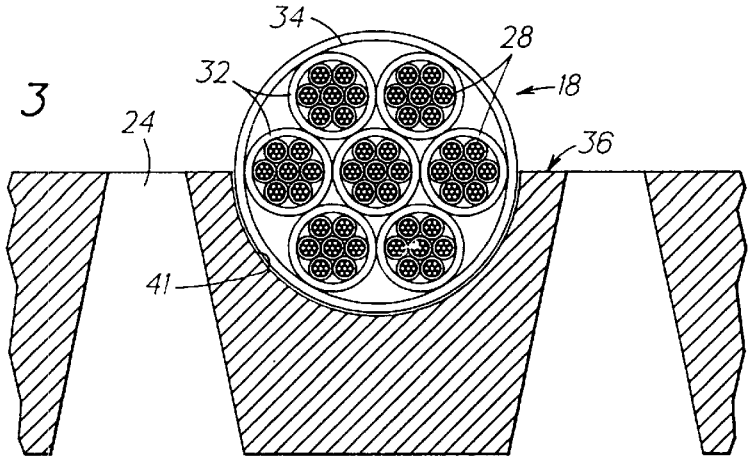

SYNTHETIC NON-METALLIC ROPE FOR AN ELEVATOR

TECHNICAL FIELD

The present invention relates to ropes for elevators, and more particularly to ropes formed from synthetic, non-metallic materials to be used in elevators having a traction sheave for driving the rope, and thereby, the elevator.

BACKGROUND OF THE INVENTION

A conventional traction type elevator includes a cab mounted in a car frame, a counterweight attached to the car frame via a rope, and a machine driving a traction sheave that is engaged with the rope. As the machine turns the sheave, friction forces between the grooved surface of the sheave and the rope move the rope and thereby cause the car frame and counterweight to raise and lower. In some applications, liners are disposed in the grooves to improve the traction between the rope and sheave and to minimize wear of the sheave and rope.

The ropes used in elevator applications have traditionally been steel wire ropes. Such ropes are inexpensive and durable. In addition, steel wire ropes tend to be flame retardant. A limiting factor in the use of steel wire ropes, however, is their weight. The higher the rise of the building or hoistway, the longer and heavier the rope becomes. The rope gradually begins to dominate the load to be carried by the elevator system until the weight of the rope exceeds the tensile strength of the rope itself. Another disadvantage is the lubrication required for steel wire ropes. The steel wire ropes are treated with an oil lubrication that ultimately becomes deposited on the hoistway equipment, in the machine room, and in the pit of the hoistway.

There has recently been much interest in replacing the traditional steel wire ropes used in elevator applications with ropes formed from high strength, lightweight synthetic materials, such as aromatic polyamid or aramid materials. Lightweight ropes formed from these materials could potentially reduce the size of many elevator components, such as machines and brakes, and could extend the rise of elevators.

The use of such synthetic ropes in traction elevators poses many problems. First, the ropes will be heavily loaded as they travel over the traction sheave. With conventional sheaves, this will introduce compressive stress onto the ropes and also cause movement of the strands of the rope relative to each other. Typical aramid materials, such as KEVLAR, have a high tensile strength but are more limited in their strength in compression. In addition, rubbing of adjacent strands causes significant abrasion of the materials and quickly degrades the strand fibers.

One proposed solution to prevent damaging abrasion from occurring is disclosed in U.S. Pat. No. 4,022,010, entitled "High-Strength Rope" and issued to Gladenbeck et al. The synthetic rope disclosed in this patent includes a sheath around either the strands or the entire rope. The sheath is formed from a synthetic plastic material, such as polyurethane, polyamide or silicone rubber and its purpose is to provide wear resistance for the strands. A similar solution is proposed in U.S. Pat. No. 4,624,097, entitled "Rope" and issued to Wilcox. A drawback to these solutions is that while permitting relative movement of the strands without abrading, this solution is not optimal for traction.

Another proposed solution is disclosed in Canadian Patent Application No. 2,142,072, entitled "Cable as Suspension Means for Lifts". The rope disclosed in this patent application includes an outer sheath that is extruded onto the outer strands to retain these strands in place while at the same time providing the necessary friction with the traction sheave. Preventing the strands from moving relative to each other, however, may introduce undesirable compressive stresses in the rope as it travels over the traction sheave and thereby limit its durability.

The above art notwithstanding, scientists and engineers under the direction of Applicant's Assignee are working to develop high strength, lightweight ropes formed from synthetic, non-metallic materials that are both effective and durable.

DISCLOSURE OF THE INVENTION

According to the present invention, a hoisting rope for an elevator includes a plurality of load carrying strands formed from a non-metallic material, each strand encased within a protective layer of coating, and a jacket surrounding the plurality of strands. The coating layers of each strand protect the strands from damage caused by abrasive contact between strands and maximize the lubricity between adjacent strands. The jacket provides the necessary traction with the traction sheave of the elevator and provides a sufficient coefficient of friction between the jacket and the coating layers to transfer the traction loads to the load carrying strands.

The advantage of the present invention is a hoisting rope formed from non-metallic materials that is effective at providing the traction while at the same time it is durable. The jacket is optimized to provide a sufficient coefficient of friction with the contact surface of the traction sheave. At the same time, the jacket interacts with the coating layers of the strands to provide a sufficient coefficient of friction to transfer the traction loads to the strands. The coating layers of each strand are optimized to permit relative movement of the strands as the rope is engaged with the sheave. This movement provides a mechanism to equalize loads on the strands. Permitting relative movement of the strands, along with protecting the strands from abrasive contact with each other, extends the useful life of the rope.

According to another aspect of the present invention, the hoisting rope includes means to minimize the effects of fire on the hoisting rope. In one embodiment, the jacket includes woven aramid fibers that behave in a flame retardant manner at temperatures below 400 F. In addition, the coating layers of each strand may provide additional resistance. In another embodiment, the jacket is formed from a material having an additive to retard the damaging effects of fire on the rope. In a further embodiment, the jacket is formed from two layers. The first layer is in contact with the traction sheave and is formed from a material selected for its traction characteristics relative to the traction sheave. The second layer is radially inward of the first layer and is formed from a material selected for its flame retardant characteristics.

According to a further aspect of the present invention, a passenger conveying system includes a hoisting rope having a jacket formed from a first non-metallic material and a traction sheave including a liner formed from a second non-metallic material. The liner is formed from a material selected such that the coefficient of friction between the liner and the hoisting rope provides optimal traction for the particular passenger conveying system. By using a nonmetallic liner and a rope having a non-metallic jacket, the materials for the liner and jacket may be selected such that the liner will wear before the jacket. In this way, the ropes and the sheave, which are more expensive to replace than the liners, will have their useful life extended. A further advantage of the nonmetallic liners is that they provide an effective means to backfit existing elevator systems having steel wire ropes with synthetic ropes and still provide the necessary traction between the existing sheave and the new synthetic ropes.

In accordance with another particular embodiment of the sheave liner, the contact surface of the liner is shaped to accommodate the hoisting rope without applying compressive forces to the rope as it travels over the sheave. As a result of this configuration, compressive forces on the nonmetallic strands can be minimized. Since conventional synthetic strands, such as those formed from aramid fibers, have significantly lower strength in compression than in tension, the durability and expected life of the synthetic rope is improved.

The foregoing and other objects, features and advantages of the present invention become more apparent in light of the following detailed description of the exemplary embodiments thereof, as illustrated in the accompanying drawings.

BRIEF DESCRIPTION OF THE DRAWINGS

FIG. 2 is a perspective cut-away view of a hoist rope according to the invention.

FIG. 3 is a sectional view of the hoist rope engaged with a sheave having a composite liner.

FIG. 4 is a sectional view of an alternate embodiment of a hoist rope according to the invention.

BEST MODE FOR CARRYING OUT THE INVENTION

Figure 1:
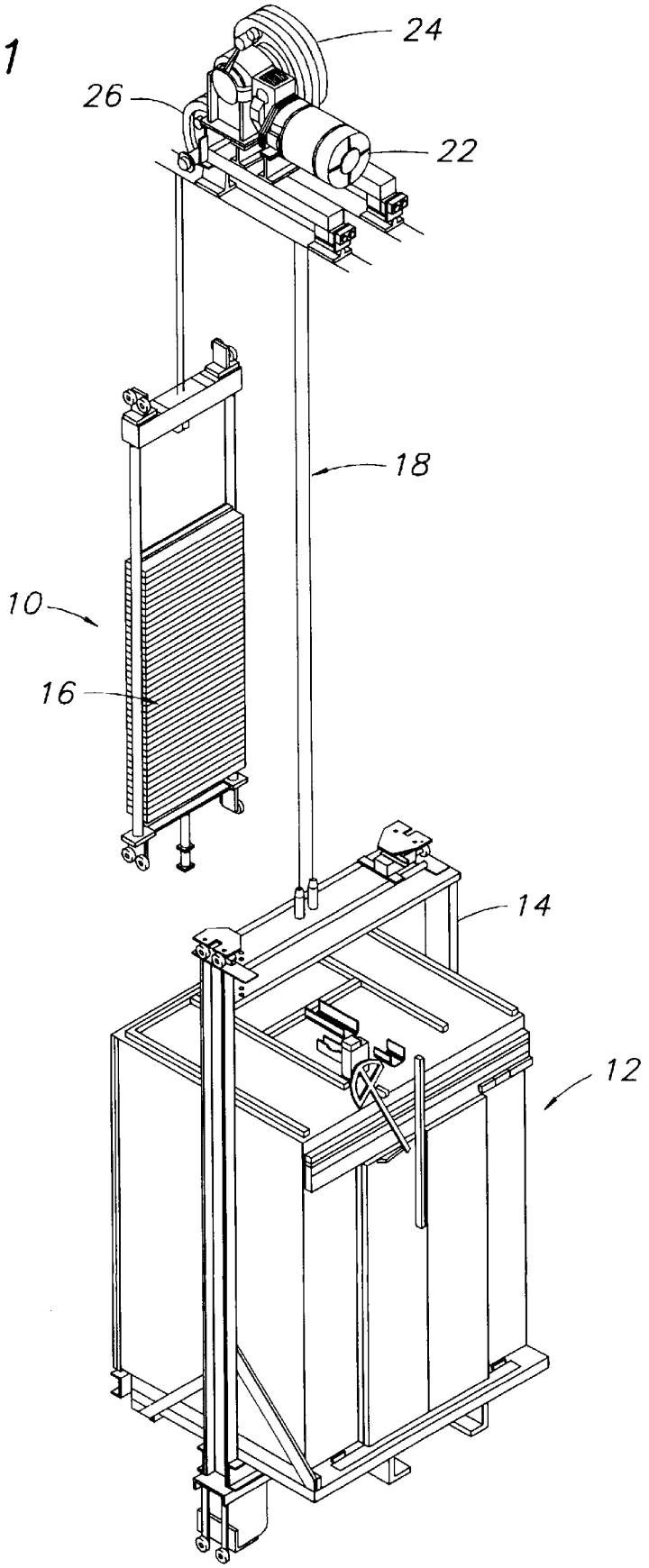
FIG. 1 is a perspective view of an elevator system with the hoistway components removed for clarity.

FIG. 1 illustrates an elevator system 10 with the hoistway and hoistway components, such as the guide rails, removed for clarity. The elevator system 10 includes a car 12 disposed in a car frame 14, a counterweight 16, a pair of hoist ropes 18 connecting the car frame 14 and the counterweight 16, a drive motor 22, and a traction sheave 24. The hoist ropes 18 extend over the traction sheave and over a deflection sheave 26. Although shown for illustrative purposes as having only two ropes, it should be apparent to one skilled in the art that a greater number of ropes may be used, with the exact number of ropes depending on the particular application.

The drive motor 22 provides the actuating force to turn the traction sheave 24. Frictional forces between the sheave 24 and the hoist ropes 18 provides the traction to pull the hoist ropes 18, and thereby move the car 12 or the counterweight 16 up and down in the hoistway. Traction between the hoist ropes 18 and the sheave 24 also provide the reactive force to hold the car frame 14 and counterweight 16 in place when the sheave 24 is not turning, such as when the car 12 is at a landing.

The hoist ropes 18 are formed from non-metallic, synthetic materials. As shown in FIG. 2, each hoist rope 18 includes a plurality of load carrying strands 28, each encased within a layer of coating 32, and a jacket 34 surrounding the plurality of strands 28. Each strand 28 is formed from synthetic, non-metallic filaments or fibers, such as a continuous polyaramid fiber material twisted into a number of high strength yams. The fibers are typically treated with a long life, non-abrasive coating to achieve nearly frictionless behavior. Such materials are well known for their high tensile strength relative to their mass.

The layer of coating 32 for each strand 28 performs three functions. The first function is to contain the twisted yams which would otherwise not be in a form for manufacturing strands. The second is to prevent abrading contact between adjacent strands 28. Such contact may rapidly degrade the performance of the hoist rope 18 and shorten the useful life of the hoist rope 18. The third function is to permit the strands 28 to move relative to each other in the rope system. Such movement is required in order to equalize loads on the strands as the hoist ropes 18 pass over the traction sheave. The movement of the strands 28 prevents the buildup of excessive compressive forces on the strands 28 and the yarns within the strands 28. The coating layers 32 are formed from a material that provides a sufficient amount of lubricity between adjacent strands 28 for the particular application. Although the amount of lubricity may vary depending upon the particular application, it is suggested that the apparent coefficient of friction between strands be approximately 0.1. A suggested material is an aramid, such as that available under the trade name of NOMEX from DupontNemours Another suggested material is urethane. As an alternative, the coating layer 32 may also include polyaramid fibers embedded in the layer 32 to provide additional strength to the coating layer 32. It should be noted, however, that the strands 28 remains the load carrying members of the hoist ropes 18.

The jacket 34 also performs several functions. The first is that it protects the strands 28 from being exposed to environmental factors, such as chemicals, and more importantly, it provides means for making the hoist ropes 18 flame retardant. The second function is to provide a sufficient coefficient of friction between the hoist rope 18 and the traction sheave 24 to produce the desired traction. It is suggested that the coefficient of friction between the rope and the traction sheave be at least 0.15, although with proper selection of the jacket and sheave liner materials, coefficients of friction of 0.4 or higher are achievable. Higher coefficients of friction between the rope and traction sheave permit higher differential loads between the car frame and counterweight. As a result, more light weight materials may be used in the design of the car frame without risk of exceeding the traction forces between the rope and traction sheave in the event of a fully loaded cab.

The third function of the jacket 34 is to provide a mechanism for transferring the traction loads from the traction sheave 24 to the strands 28. For this function, it is suggested that the coefficient of friction between the jacket 34 and the coating layer 32 be greater than or equal to 0.15. To perform these latter two functions, the material for the jacket 34 must take into account the contact surface of the traction sheave 24 and the material selected for the coating layer 32 of the strands 28. A suggested material for the jacket 34 is a blend of woven polyaramid and urethane. The woven polyaramid will provide flame retardant characteristics to the jacket 34, with greater percentages of woven polyaramid providing more flame retardant characteristics; however, the greater the percentage of woven polyaramid in the jacket 34, the lower the coefficient of friction may become. Therefore, the precise blend of woven polyaramid and urethane is dependent upon the particular application. As an alternative, chemical additives, such as halogens, may be mixed with the urethane to provide the desired flame retardant characteristics. As used herein, "flame retardant" means a material that is self extinguishing once the active flame is removed from the material.

As another alternative configuration, a jacket 42 may be formed from multiple layers as shown in FIG. 4. The first, or outer, layer 44 is selected for its friction characteristics relative to the sheave 24 contact surface. The second, or inner, layer 46 is selected for its flame retardant characteristics and for its friction characteristics relative to the coating layers 32 of the strands 28.

The engagement of the hoist ropes 18 and the traction sheave 24 is illustrated in FIG. 3. The traction sheave 24 includes a sheave liner 36 formed from a material selected for its durability and having friction characteristics tailored for the engagement with the jacket 34 of the hoist rope 18 without resulting in undue wear of the hoist rope 18. If properly selected, the sheave liner 36 will have a lower wear resistance than the jacket 34 such that the sheave liner 36 will wear prior to the jacket 34. A suggested material for the liner 36 is polyurethane. In this way, the sheave liner 36 produces the desired traction with the hoist ropes 18 while at the same time providing an easily, and inexpensively, replaceable element that will receive the predominant amount of wear during operation.

The engagement between the hoist ropes 18 and sheave 24 results in the strands 28 moving within the jacket 34 because of the lubricity of the coating layers 32 on the strands 28. As stated previously, this movement accommodates the forces on the plurality of strands 28. In addition, the sheave liner 36 has an engagement surface 41 that approximates the shape of the unloaded hoist rope 18. This shaped contact surface does not pinch or introduce concentrated shear loads on the rope as the rope deflects to provide sufficient traction. In this way, undesirable compressive loads are avoided on the hoist rope 18. For hoist ropes 18 formed from polyaramid materials, minimizing the compressive forces on the polyaramid fibers contributes to extending the useful life of the hoist rope 18. This is the result of the polyaramid fibers having compressive strength that is significantly less than their tensile strength. By having a contact surface 41 that is radiused or circular in section rather than tapered or undercut, as is conventional with steel wire ropes, the compressive forces on the strands 28 of the hoist rope 18 are minimized.

Although various materials are suggested herein for the strands, coating layers and jacket, it should be apparent to one skilled in the art that many materials could be chosen, depending upon the particular application, that would result in a hoist rope having load carrying strands formed from polyaramid fibers, with each strand having a coating layer that provides a low coefficient of friction relative to the other strands but which also provides a higher coefficient of friction relative to the jacket, and a jacket that provides an adequate coefficient of friction relative to the traction sheave.

Although the invention has been shown and described with respect to exemplary embodiments thereof, it should be understood by those skilled in the art that various changes, omissions, and additions may be made thereto, without departing from the spirit and scope of the invention.

What is claimed is:

1. A hoisting rope for an elevator, the hoisting rope being engageable with a traction sheave for driving the elevator, the hoisting rope including:

a plurality of load carrying strands formed from a non-metallic material, each strand encased within a layer of coating, the layers of coating permitting relative movement between adjacent strands; and a jacket surrounding the plurality of strands, the jacket being engageable with the traction sheave to provide sufficient traction to drive the elevator, and wherein the jacket is formed from a material such that the plurality of strands are permitted longitudinal movement relative to the jacket in the portions of the rope not engaged with the traction sheave.

2. The hoisting rope according to claim 1, wherein the jacket includes a first inner layer formed from a material that is flame retardant.

3. The hoisting rope according to claim 1, wherein the jacket includes a layer formed from urethane material having an additive providing flame retardant characteristics.

4. The hoisting rope according to claim 1, wherein the jacket is formed from a material having polyaramid fibers embedded therein.

5. The hoisting rope according to claim 1, wherein the layer of coating for each strand is formed from a urethane material.

6. The hoisting rope according to claim 5, wherein the urethane material includes polyaramid fibers embedded therein.

7. An passenger conveying system having a car frame moving along a path, the car frame being driven by a machine, the passenger conveying system including:

a traction sheave engaged with the machine, the traction sheave including a groove;

a sheave liner disposed in the groove, the sheave liner having a contact surface; and a hoist rope engaged with the car frame and the traction sheave, the hoist rope including:

a plurality of load carrying strands formed from a non-metallic material; and a jacket surrounding the plurality of strands, the jacket being engageable with the contact surface to provide sufficient traction to drive the elevator;

wherein the contact surface is shaped to accommodate the rope such that compressive forces on the rope are minimized as the rope deflects during, engagement with the traction sheave.

8. The passenger conveying system according to claim 7, wherein each strand is encased within a layer of coating, the layers of coating permitting relative movement between adjacent strands.

9. The passenger conveying system according to claim 7, wherein the jacket is formed from a material such that the plurality of strands are permitted longitudinal movement relative to the jacket in the portions of the rope not engaged with the traction sheave.

10. The passenger conveying system according to claim 7, wherein the sheave liner is formed from a first non-metallic material, the jacket is formed from a second non-metallic material, and wherein the engagement between the sheave liner and jacket produces an apparent coefficient of friction between 0.15 and 0.4.

11. A hoisting rope for an elevator, the hoisting rope being engageable with a traction sheave for driving the elevator, the hoisting rope including:

a plurality of load carrying strands formed from a non-metallic material, each strand encased within a layer of coating, the layers of coating permitting relative movement between adjacent strands; and a jacket surrounding the plurality of strands, the jacket being engageable with the traction sheave to provide sufficient traction to drive the elevator.

12. The hoisting rope according to claim 11, wherein the jacket includes a first inner layer formed from a material that is flame retardant.

13. The hoisting rope according to claim 11, wherein the jacket includes a layer formed from urethane material having an additive providing flame retardant characteristics.

14. The hoisting rope according to claim 11, wherein the jacket is formed from a material having polyaramid fibers embedded therein.

15. The hoisting rope according to claim 11, wherein the layer of coating for each strand is formed from a urethane material.

16. The hoisting rope according to claim 15, wherein the urethane material includes polyaramid fibers embedded therein.

17. The hoisting rope according to claim 11, wherein the jacket is formed from a material such that the plurality of strands are permitted movement relative to the jacket in the portions of the rope not engaged with the traction sheave.

18. A hoisting rope for an elevator, the hoisting rope being engageable with a traction sheave for driving the elevator, the hoisting rope including:

a plurality of load carrying strands formed from a non-metallic material, each strand encased within a layer of coating; and a jacket surrounding the plurality of strands, the jacket being engageable with the traction sheave to provide sufficient traction to drive the elevator, and wherein the jacket is formed from a material such that the plurality of strands are permitted movement relative to the jacket in the portions of the rope not engaged with the traction sheave.

19. The hoisting rope according to claim 18, wherein the jacket includes a first inner layer formed from a material that is flame retardant.

20. The hoisting rope according to claim 18, wherein the jacket includes a layer formed from urethane material having an additive providing flame retardant characteristics.

21. The hoisting rope according to claim 18, wherein the jacket is formed from a material having polyaramid fibers embedded therein.

22. The hoisting rope according to claim 18, wherein the layer of coating for each strand is formed from a urethane material.

23. The hoisting rope according to claim 22, wherein the urethane material includes polyaramid fibers embedded therein.

24. A hoisting rope for an elevator, the hoisting rope being engageable with a traction sheave for driving the elevator, the hoisting rope including:

a plurality of load carrying strands formed from a non-metallic material; and a jacket surrounding the plurality of strands, the jacket being engageable with the traction sheave to provide sufficient traction to drive the elevator, and wherein the jacket includes a material that is flame retardant.

25. The hoisting rope according to claim 24, wherein the jacket includes a first layer formed from a material that is flame retardant.

26. The hoisting rope according to claim 25, wherein the first layer is formed from a urethane material having an additive providing flame retardant characteristics.

27. The hoisting rope according to claim 24, wherein the jacket includes a urethane material having an additive providing flame retardant characteristics.

28. The hoisting rope according to claim 24, wherein the jacket is formed from a material having polyaramid fibers embedded therein.

29. A passenger conveying system having a car frame moving along a path, the car frame being driven by a machine, the passenger conveying system including:

a traction sheave engaged with the machine, the traction sheave including a groove;

a hoist rope engaged with the car frame and the traction sheave, the rope including a plurality of load carrying strands and a jacket surrounding the plurality of strands, the jacket formed from a non-metallic material; and a sheave liner disposed in the groove, the sheave liner having a contact surface engaged with the jacket to provide sufficient traction to drive the elevator, wherein the sheave liner is formed from a material having a lower wear resistance than the jacket, such that the sheave liner will receive the predominant amount of wear during operation of the passenger conveying system as compared to the jacket.

30. The passenger conveying system according to claim 29, wherein the loadcarrying strands are formed from a non-metallic material.

31. The passenger conveying system according to claim 30, wherein each strand is encased within a layer of coating, the layers of coating permitting relative movement between adjacent strands.

32. The passenger conveying system according to claim 29, wherein the jacket is formed from a material such that the plurality of strands are permitted longitudinal movement relative to the jacket in the portions of the rope not engaged with the traction sheave.

33. The passenger conveying system according to claim 29, wherein the contact surface is shaped to accommodate the rope such that compressive forces on the rope are minimized as the rope deflects during engagement with the traction sheave.

34. The passenger conveying system according to claim 29, wherein the engagement between the sheave liner and jacket produces an apparent coefficient of friction between 0.15 and 0.4.

* * * * *